US007077712B2

(12) United States Patent
Sakaguchi et al.

(10) Patent No.: US 7,077,712 B2
(45) Date of Patent: Jul. 18, 2006

(54) JOINTING SLEEVE COMPONENT AND JOINT ELECTRIC WIRE

(75) Inventors: Tadahisa Sakaguchi, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/174,543

(22) Filed: Jul. 6, 2005

(65) Prior Publication Data

US 2006/0057904 A1 Mar. 16, 2006

(30) Foreign Application Priority Data

Sep. 13, 2004 (JP) ..... 2004-265540

(51) Int. Cl.
*H01R 4/18* (2006.01)

(52) U.S. Cl. ..... 439/877; 439/884; 439/948

(58) Field of Classification Search ..... 439/877, 439/878, 884, 289, 948
See application file for complete search history.

(56) References Cited

U.S. PATENT DOCUMENTS 2,794,964 A * 6/1957 Hoffman ..... 439/877
5,281,760 A * 1/1994 Kikuchi et al. ..... 174/74 R
5,356,318 A * 10/1994 Fry et al. ..... 439/877
5,567,187 A * 10/1996 Bellinger ..... 439/877
5,989,080 A * 11/1999 Tsuji et al. ..... 439/884
2002/0061688 A1* 5/2002 Hanazaki et al. ..... 439/877
2004/0157505 A1* 8/2004 Kuwayama et al. ..... 439/877

FOREIGN PATENT DOCUMENTS

JP 2001-326053 11/2001
JP 2002-216916 8/2002

* cited by examiner

*Primary Examiner*—Hien Vu
(74) *Attorney, Agent, or Firm*—Armstrong, Kratz, Quintos, Hanson & Brooks, LLP

(57) ABSTRACT

The jointing sleeve component includes a sleeve made of electrically conductive metal. A diameter of the sleeve is to be reduced by swaging on a condition that core wire ends of a plurality of coated electric wires are received in the sleeve. Each core wire end is obtained by removing an insulating coating from the coated electric wire. The jointing sleeve component electrically connects the core wire ends to each other. The sleeve is formed in a pipe-shape from a developed material, which is stamped out from a plate made of the electrically conductive metal to have a specific shape.

5 Claims, 4 Drawing Sheets

JOINTING SLEEVE COMPONENT AND JOINT ELECTRIC WIRE

BACKGROUND OF THE INVENTION (1) Field of the Invention

The present invention relates to a jointing sleeve component used for electrically connecting a plurality of core wire ends to each other, at each of which core wire end an insulating coating of a coated electric wire is removed, and a joint electric wire.

(2) Description of the Related Art

So far, when a joint electric wire has been formed, a pipe-shaped sleeve, both ends of which are formed open, has been used. As shown in FIGS. 7A and 7B, a long pipe material is cut into a specific length thereof and thereafter, subjected to plating, thereby the sleeve 41 is obtained.

When core wire ends 43*b* are connected to each other by using the sleeve 41, the core wire ends 43*b* are inserted from one end 42*a* of the sleeve 41, then front ends of the core wire ends 43*b* are exposed from an opposite end 42*b* of the sleeve 41, then the sleeve 41 is subjected to provisional crimping by using a crimping tool such as a hand tool, then the sleeve 41 is inserted in between dies 45 facing each other of rotary swaging device and then, the sleeve 41 is uniformly reduced in its diameter by swaging, so that the sleeve 41 and the core wire ends 43*b* are closely crimped to each other without a gap.

As another conventional example of the sleeve, proposed is a sleeve for a shielded electric wire, which is mounted to an end of one shielded electric wire and by which an inversion processing of a braided wire can be easily effectively performed (Japanese Patent Application Laid-Open No. 2002-216916) or a sleeve, which is mounted to an end of one coated electric wire for connecting an electric wire and a terminal to each other (Japanese Patent Application Laid-Open No. 2001-326053).

However, since a long pipe material is manufactured from a board material by consuming a lot of time and labor hour through many steps such as pressing, rolling and welding, therefore there is a problem that a material cost is high. Further, since it is not easy to subject additional processing such as spreading and pressing to a pipe material, therefore there is a problem that a production cost is high. Accordingly, so far, a pipe piece, which is obtained by cutting a pipe material, has not been subjected to any processing or, alternatively, an additional processing is limited to a processing, in which a guiding taper is formed at an open end of a sleeve.

Moreover, since dimensions of inner and outer diameters are determined to some extent, therefore there is a problem that it is not possible to obtain a pipe material having a dimension in accordance with a size of an electric wire. Accordingly, when the number of coated electric wires 43 to be jointed is changed or when a thickness of a coated electric wires 43 is changed, a size of the sleeve 41 cannot be changed according to a size of the electric wire 43 causing a fluctuation in a gap between the sleeve 41 and the electric wires 43, causing a problem that the electric wires 43 are excessively compressed or insufficiently compressed and a crimping force fluctuates depending on the size of the electric wire 43, and a uniform crimping force cannot be attained.

In order to prevent the sleeve 41 from moving along the coated electric wire 43 during swaging, the sleeve 41 is crushed by using a crimping tool or the like so as to be provisionally crimped to the core wire ends 43*b*. However, when the sleeve 41 is crushed into a deformed shape, the property of the swaging is deteriorated, causing a problem that the sleeve 41 and the core wire ends 43*b* cannot be provisionally crimped to each other sufficiently firmly. If the provisional crimping force is weak, the sleeve 41 might move during swaging, causing a problem that the insulating coating 43*a* is caught by the sleeve 41 moved causing breakage of the insulating coating 43*b* or deterioration in crimping force of a swaged part.

Moreover, when the sleeve 41 and the core wire ends 43*b* are provisionally crimped to each other, a jig for positioning or the like must be used in order to fix a positional relation between the sleeve 41 and the core wire ends 43*b*, causing a problem that workability in connection of a joint electric wire is deteriorated.

SUMMARY OF THE INVENTION

It is therefore an objective of the present invention to solve the above problems and to provide a jointing sleeve component and a joint electric wire, by which the material cost can be reduced and the fluctuation in the crimping force can be reduced so as to improve in reliability of the crimp connection.

Another objective of the present invention to provide a jointing sleeve component and a joint electric wire, by which the positional relation between the sleeve and the electric wires can be fixed, the insulating coating is prevented from being caught or broken, and the quality stability and workability in connection of the joint electric wire can be improved.

In order to attain the above objective, the present invention is to provide a jointing sleeve component including:

a sleeve made of electrically conductive metal, wherein a diameter of the sleeve is to be reduced by swaging on a condition that core wire ends of a plurality of coated electric wires are received in the sleeve, each core wire end being obtained by removing an insulating coating from the coated electric wire, so that the jointing sleeve component electrically connects the core wire ends to each other, wherein the sleeve is formed in a pipe-shape from a developed material, which is stamped out from a plate made of the electrically conductive metal to have a specific shape.

With the construction described above, the sleeve is formed from the developed material stamped, the material cost can be greatly reduced in comparison with that of a conventional sleeve, which is formed from a pipe-shaped material through many steps. Further, even when the number of the coated electric wires to be jointed changes or even when the thickness of the coated electric wire changes, since a die for press molding can be changed to another die having different dimension, therefore a sleeve can be formed according to a size of the wire to be jointed. Accordingly, the material cost can be reduced and fluctuation in the magnitude of the crimping force can be reduced, thereby improving the reliability of the crimping connection.

Preferably, at an end of the sleeve an abutting part abutting against at least a part of an end of the core wire ends, which are inserted from an opposite end of the sleeve, is formed.

With the construction described above, since the abutting part is formed at one end of the sleeve, such a end that is an open end is prevented from being completely closed and the exposed end of the core wire ends can abut against the abutting part. Therefore, by seeing from the outside that the end of the core wire ends of the insulating coating abuts against the abutting part, the positioning of the wires in the inserting direction of the wires can be uniformly carried out without using a positioning jig. Further, the sleeve can be prevented from biting (entering into) the insulating coating.

Preferably, a crimping piece for crimping the insulating coatings is formed at the opposite end of the sleeve.

With the construction described above, since the crimping piece is applied on a condition that the core wire ends are inserted in the sleeve, the insulating coatings and the crimping piece can be closely crimped, thereby fixing the positional relation between the sleeve and the core wire ends. Therefore, a relative movement between the sleeve and the core wire ends is prevented from occurring, the sleeve is prevented from coming off from the electric wires improving the workability on the jointing connection, upon swaging the sleeve is prevented from biting into the insulating coating, the insulating coating is prevented from peeling off, the crimping force can be prevented from being reduced, and stable product quality of the joint electric wire can be attained.

Preferably, an engaging part is formed at one edge of the pipe-shaped sleeve and a mating engaging part, which faces and engages with the engaging part, is formed at an opposite edge of the pipe-shaped sleeve.

With the construction described above, the one edge and opposite edge of the pipe-shaped sleeve facing each other can be prevented from shifting in the axial direction of the sleeve. Particularly, upon swaging the sleeve, which is simultaneously affected by pressure applied inwardly in the radial direction, an insertion resistance in the axial direction and a rotation force in the circumferential direction, can be prevented from extending in the axial direction with being twisted. Since the engaging part engages with the mating engaging part, the one edge and opposite edge of the pipe-shaped sleeve facing each other can be prevented from shifting in the axial direction of the sleeve. Accordingly, end faces can be prevented from shifting at both ends of the sleeve, thereby preventing the sleeve from biting into the insulating coatings.

Further, the present invention is to provide a joint electric wire including:

a plurality of coated electric wires each having core wire ends obtained by removing an insulating coating from the coated electric wire; and a jointing sleeve component, including a sleeve made of electrically conductive metal, for electrically connecting the core wire ends to each other by swaging the sleeve, which sleeve receives the core wire ends therein, wherein the jointing sleeve component is the jointing sleeve component as described above.

With the construction described above, since the joint electric wire includes the jointing sleeve component formed from the developed material, the cost of the joint electric wire can be reduced. The sleeve can be formed to have a dimension according to a size of the electric wire to be jointed. The reliability of the crimping connection can be improved. Further, the insulating coatings can be prevented from being bitten by the sleeve and from peeling off, thereby improving the production quality of the joint electric wire.

DESCRIPTION OF THE PREFERRED EMBODIMENTS

In the following, the preferred embodiments of the present invention will be explained with reference to the attached drawings. FIGS. 1–4 show a preferred embodiment of a jointing sleeve component of the present invention.

Figure 1:
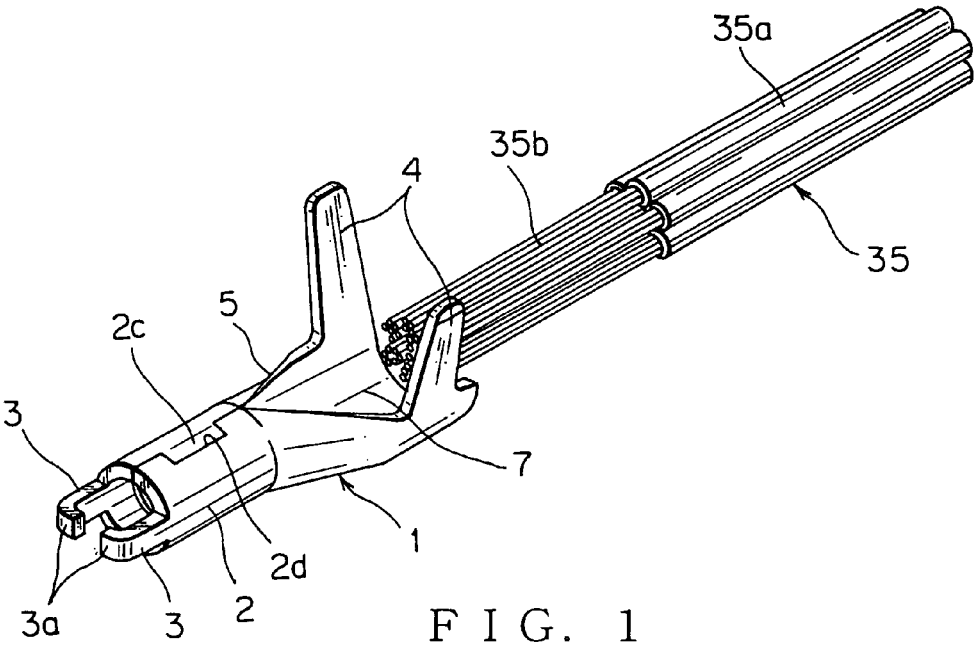
FIG. 1 is a perspective view illustrating a preferred embodiment of a jointing sleeve component of the present invention.
Figure 6:
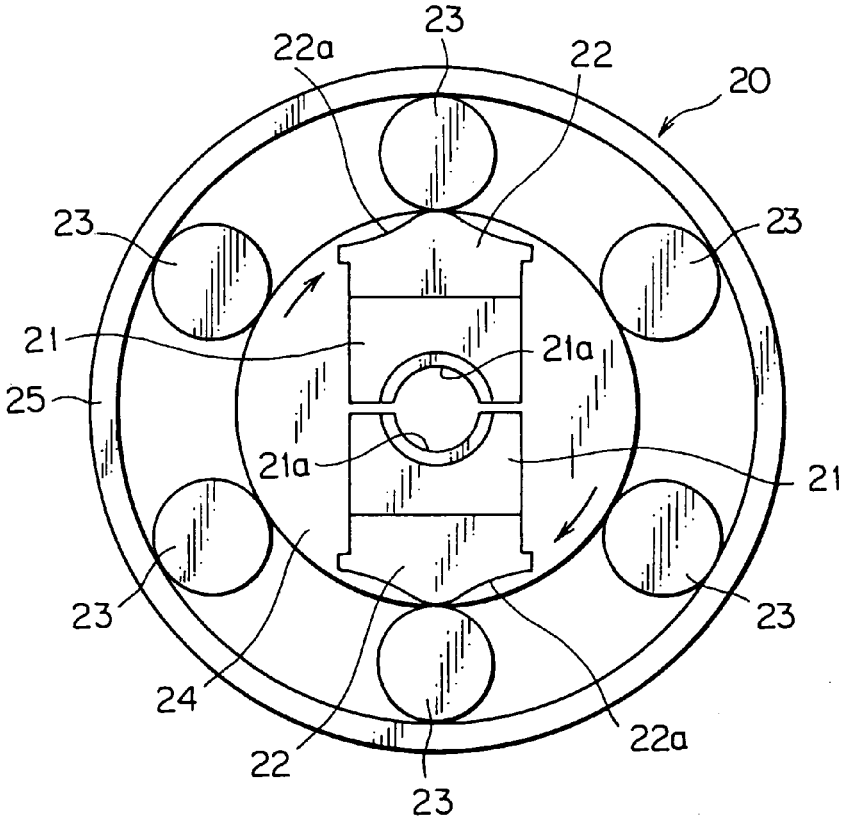
FIG. 6 is a front view of a rotary swaging device for swaging the sleeve of the jointing sleeve component.
Figure 4:
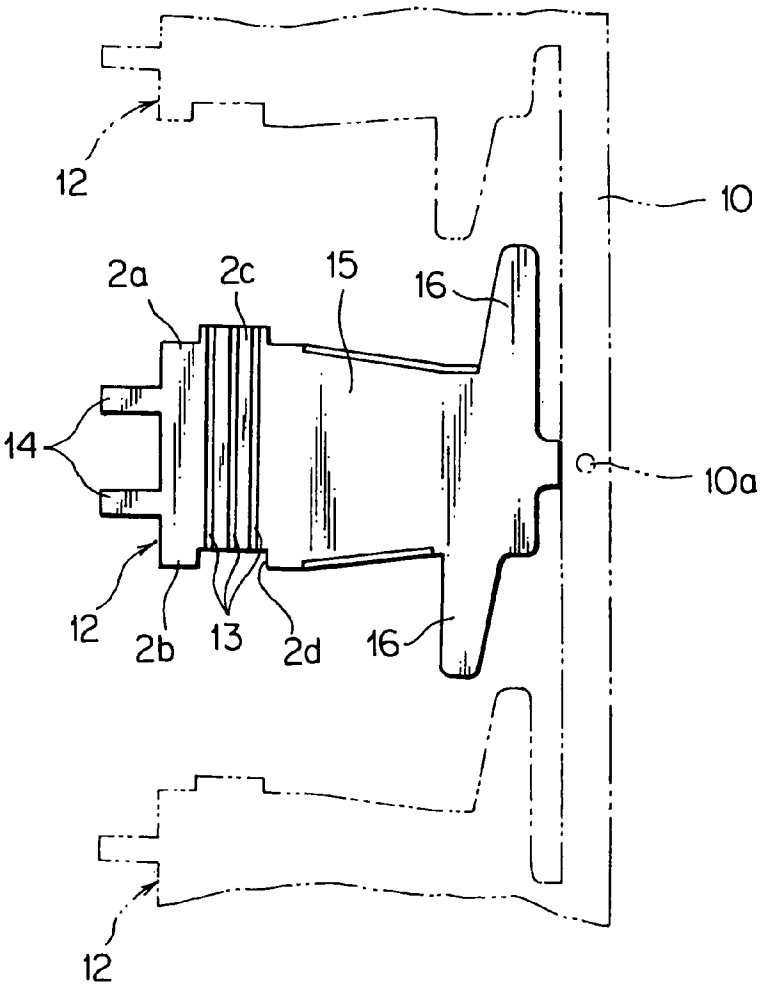
FIG. 4 is a development of a jointing sleeve component of the present invention.

As shown in FIG. 1, the jointing sleeve component (hereinafter, sleeve component) 1 according to the preferred embodiment includes a sleeve (i.e. sleeve part) 2 formed by bending a developed material 12 (shown in FIG. 4) into a pipe-shape, wherein the developed material 12 is stamped out to have a specific shape from a plate made of electrically conductive metal such as copper, which has been plated.

Both ends of the pipe-shaped sleeve 2 are formed open so that core wire ends 35*b*, which are obtained by removing insulating coatings 35*a* from a plurality of coated electric wires 35, can be inserted into the sleeve 2. The sleeve 2 is reduced in its diameter by swaging, thereby electrically connecting the core wire ends 35*b* to each other. A joint electric wire (not shown in the figure) includes a plurality of the coated electric wires 35 and the sleeve component 1 for electrically connecting the core wire ends 35*b* to each other.

An inner diameter of the sleeve 2 is formed to have a dimension a little larger than an outer diameter of the core wire ends 35*b* to be jointed so that the core wire ends 35*b* can be smoothly inserted into the inside of the sleeve 2 by using small insertion force. A length of the sleeve 2 is formed to be shorter than that of the core wire ends 35*b* so as to prevent the insulating coatings 35*a* from being bitten.

Since the sleeve 2 is formed by bending the developed material 12, the sleeve 2 has a pair of edges 2*a*, 2*b* facing each other in a direction crossing at right angles with the axial direction of the sleeve 2, that is, in a direction in which the developed material 12 is bent. A gap is formed between the pair of the edges 2*a*, 2*b* and the reduction rate of the sleeve 2 due to the swaging is adjusted according to the size of the electric wire, allowing the sleeve 2 and the core wire ends 35*b* to adhere to each other without a gap.

Figure 2:
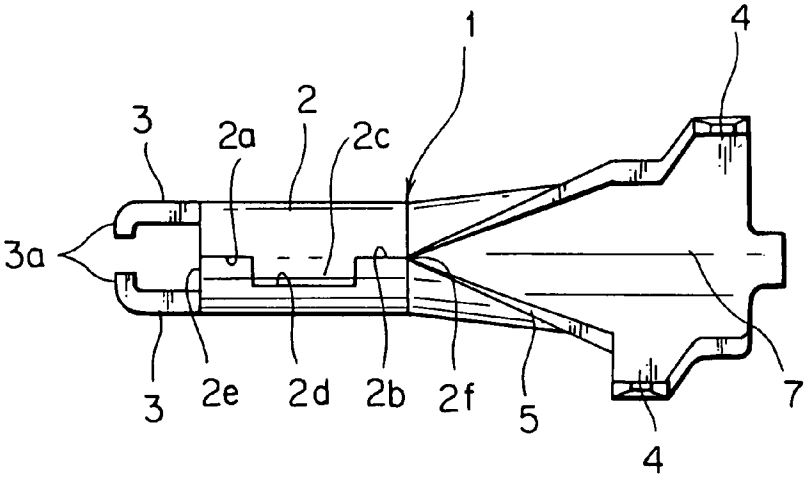
FIG. 2 is a plan view of a jointing sleeve component of the present invention.

As shown in FIG. 2, an engaging projection (an engaging part) 2c is formed at one edge 2*a* of the sleeve 2, while an engaging recess (a mating engaging part) 2*d*, which faces and engages with the engaging projection 2*c*, is formed at an opposite edge 2*b* of the sleeve 2. The engaging projection 2*c* and the engaging recess 2*d* engage with each other, thereby preventing the pair of the edges 2*a*, 2*b* from shifting positionally in the axial direction of the sleeve 2. During the swaging, the sleeve 2 is affected by force simultaneously from three directions crossing at right angles with one another, that is, the radial direction, axial direction and circumferential direction. However, since the pair of the edges 2*a*, 2*b* facing each other are engaged with each other, therefore the pair of the edges 2*a*, 2*b* is prevented from shifting positionally in the axial direction of the sleeve 2, that is, the sleeve 2 is prevented from being deformed excessively, so that the sleeve 2 is compressed uniformly in the circumferential direction.

A pair of abutting parts 3, 3 facing each other is formed in a hoe-shape at a core wires-guiding out end, which is an open end positioned on the front side in the wire-inserting direction of the sleeve 2. Each abutting part 3 has a L-shape and has an abutting end 3*a* bent inwardly at about right angles. A gap between the abutting ends 3*a* facing each other is smaller than the outer diameter of the core wire ends 35*b*.

A portion except for the pair of abutting parts 3, 3 is formed open, so that an end of the inserted core wire ends 35*b* is exposed and can be seen from the outside, thereby enabling secure positioning of the coated electric wire 35. In this connection, it may be possible to provide the abutting part inside a core wire guiding-out end 2*e*. In such a case, since the end of the core wire ends 35*b* is not exposed to the outside, the end cannot be seen from the outside.

Since the end of the core wire ends 35*b* inserted in the sleeve 2 abuts against an inner surface of the abutting end 3*a*, therefore the coated wire 35 is uniformly positioned in the wire-insertion direction, thereby improving workability of the connection of the joint electric wire. Since the position at which the coated wire 35 is positioned is a position where the insulating coating 35*a* is not bitten by the sleeve 2, therefore a defective crimping is prevented from occurring.

At a core wire guiding-in end 2*f*, which is a rear open end from which the core wire ends 35*b* are inserted into the sleeve 2, there is formed a flare part 5, which is a part gradually extending in its diameter in the rearward direction in a bugle-shape. Since the flare part 5 is formed, the core wire ends 35*b* being inserted is guided and smoothly inserted into the sleeve 2, thereby preventing element cores of the core wire ends 35*b* from coming loose or coming out to the outside. Since the flare part 5 is a part, which is not swaged, therefore an edge part situated on the side of the rear end of the sleeve 2 is prevented from biting the core wire ends 35*b*, thereby the core wire ends 35*b* is prevented from being damaged, for example, from being cut.

Figure 3:
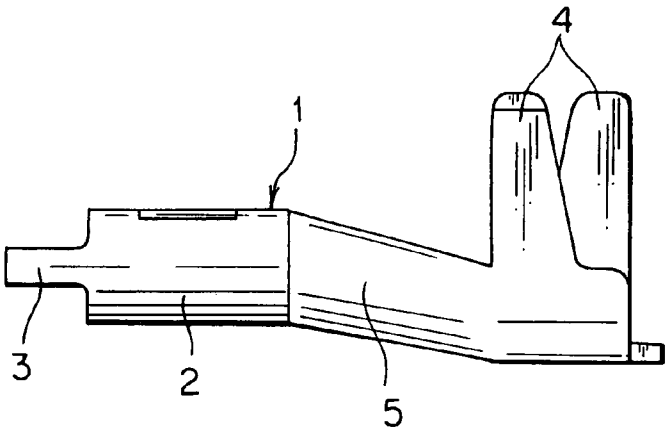
FIG. 3 is a side view of a jointing sleeve component of the present invention.

As shown in FIG. 3, at the rear side of the flare 5, a pair of crimping pieces 4, 4 to be crimped to the insulating coating 35*a* is alternately formed rising up. A rising length of-each crimping piece 4 is set so that when each crimping piece 4 is crimped, the whole outer periphery of the insulating coating 35*a* is held by a base wall 7 and the crimping pieces 4. In the present invention, the crimping means is not necessarily limited to the pair of the crimping pieces 4, however, if the pair of the crimping pieces 4 is alternately formed as described above, the crimping pieces 4 are rigidly crimped without overlapping with each other, thereby increasing a crimping area between the insulating coating 35*a* and the crimping piece 4 and increasing the crimping force.

Since the pair of the crimping pieces 4 is formed, the positional relation between the sleeve component 1 and the electric wires 35 can be fixed, and the sleeve 2 can be crimp-connected to the core wire ends 35*b* without the insulating coating 35*a* being bitten by the sleeve 2 during the swaging. Further, by the synergistic effect in combination with the pair of the abutting parts 3, the positional relation between the sleeve component 1 and the electric wires 35 can be fixed on a condition that the coated electric wires 35 are uniformly positioned, thereby improving workability of the joint connection.

In the following, a process for manufacturing the sleeve component 1 will be explained. A plate material made of electrically conductive metal, which is carried into a terminal manufacturing line on a condition that the plate material is wound around a reel (not shown in the figure), is manufactured through the steps consisting of a punching-out step, bending step and cutting step. In the punching-out step, by using a pressing mold corresponding to a size of the electric wire to be jointed, the sleeve component 1 is formed by punching-out the plate material into developed materials 12 in a state that each developed material 12 is linked to a chain belt 10, thereby obtaining the developed material 12 shown in FIG. 4. The developed materials 12 are linked to the chain belt 10 being arranged in a line with a specific pitch.

A pair of leg parts 14, 14 is projectingly formed on the front side of each developed material 12. An end of the leg part 14 is bent at right angles to become the abutting part 3 of the sleeve component 1. A body part 15 is formed continuing to the leg part 14. The front part of the body part 15 is bent to become the sleeve 2 of the sleeve component 1 and provided with three serrations 13 extending in a direction crossing at right angles with the axis of the coated electric wire 35 to be connected. The serrations 13 prevent the core wire ends 35*b* from slipping. The edges 2*a* and 2*b* facing each other situated at both sides of the front side of the body part 15 are provided with the engaging projection 2*c* and engaging recess 2*d*, respectively, which engage with each other for preventing the respective edges 2*a* and 2*b* from shifting.

At the rear end of the body part 15, a pair of arm parts 16, 16 is alternately formed each projecting outwardly. The arm part 16 becomes the crimping piece 4 of the sleeve component 1. A part of the chain belt 10 remains at the rear end of the developed material 12.

In the bending step, the pipe-shaped sleeve 2 is formed by guide bending with a pressing machine. The sleeve 2 is bent taking a spring back into consideration so as to maintain the pipe-shape thereof. In the cutting step, the sleeve component 1 is separated from the chain belt 10. In each step, the processing is carried out with an automatic pressing machine and an intermediate product is automatically forwarded to the subsequent step in turn by using pilot holes 10*a* formed in the chain belt 10, thereby continuously manufacturing the sleeve component 1 shown in FIGS. 1–3.

Figure 5A:
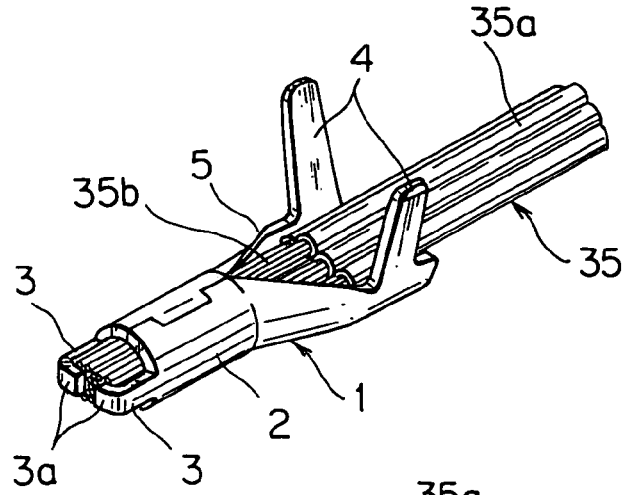
FIG. 5A is a view illustrating a state when the ends of the electric wires are allowed to abut against the abutting part of the jointing sleeve component, as an illustration of a connection process of the ends of the joint electric wires.

In the following, a method of connecting the end of the joint electric wire by using the sleeve component 1 according to the preferred embodiment will be explained with reference to FIG. 5. FIG. 5A shows a state when the core wire ends 35*b* of the coated electric wires 35 to be jointed are inserted to a regular position from the flare part 5 of the sleeve component 1 and the end of the core wire ends 35*b* abuts against the abutting end 3*a* of the abutting part 3 so as to be positioned in the insertion direction. In a state that the coated electric wires 35 is inserted to the regular position, the end of the core wire ends 35*b* is exposed from the end of the sleeve 2 and can be seen from the outside. Thus, since the end of the core wire ends 35*b* can be seen from the outside, it is confirmed that the core wire ends 35*b* are positioned.

Figure 5B:
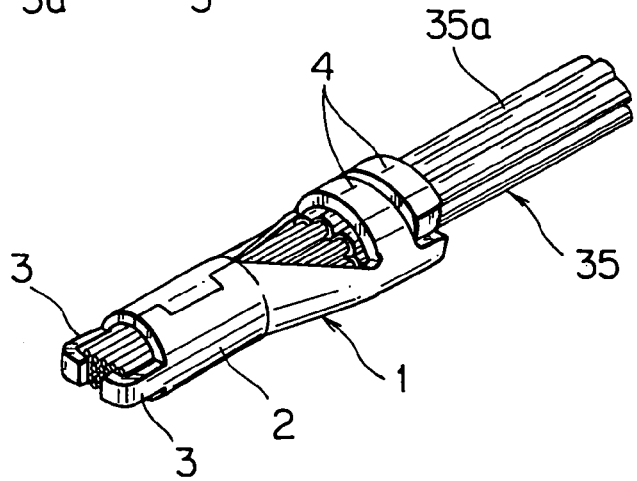
FIG. 5B is a view illustrating a state when a pair of the crimping pieces are applied, as an illustration of a connection process of the ends of the joint electric wires.

Further, in a state that the coated electric wires 35 is inserted to the regular position, the insulating coatings 35*a* are positioned at a corresponding position where the pair of the crimping pieces 4, 4 is located, as shown in FIG. 5B, the crimping pieces 4 are securely crimped to the insulating coatings 35*a*. Since the pair of the crimping pieces 4, 4 is alternately wound around the outer periphery of the insulating coatings 35*a* in so-called a wrap-around form, the insulating coatings 35*a* are tightly crimped closely without a gap. When the pair of the crimping pieces 4, 4 is crimped, the positional relation between the sleeve 2 and the core wire ends 35*b* is fixed.

Figure 5C:
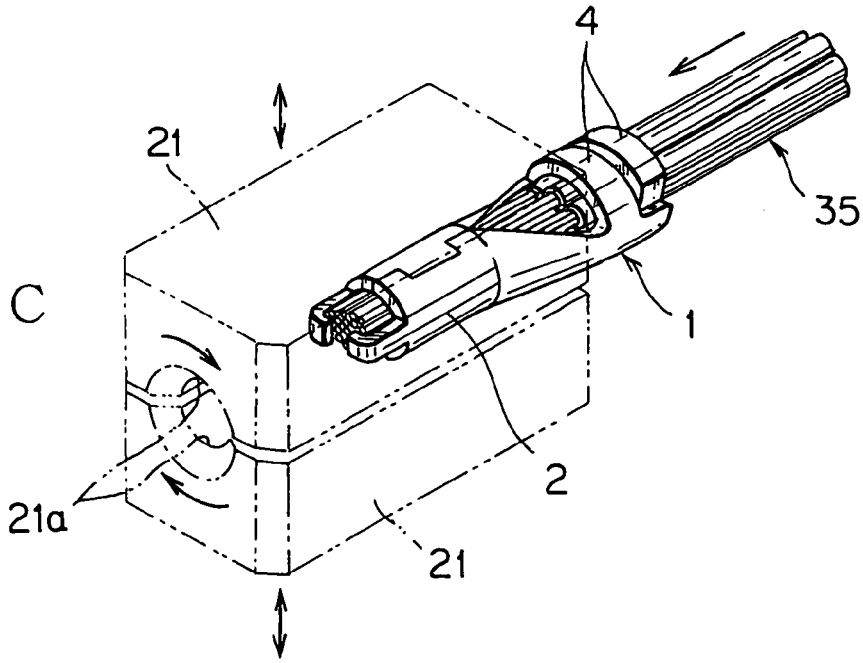
FIG. 5C is a view illustrating a state when the sleeve of the jointing sleeve component is swaged, as an illustration of a connection process of the ends of the joint electric wires.
Figure 7A:
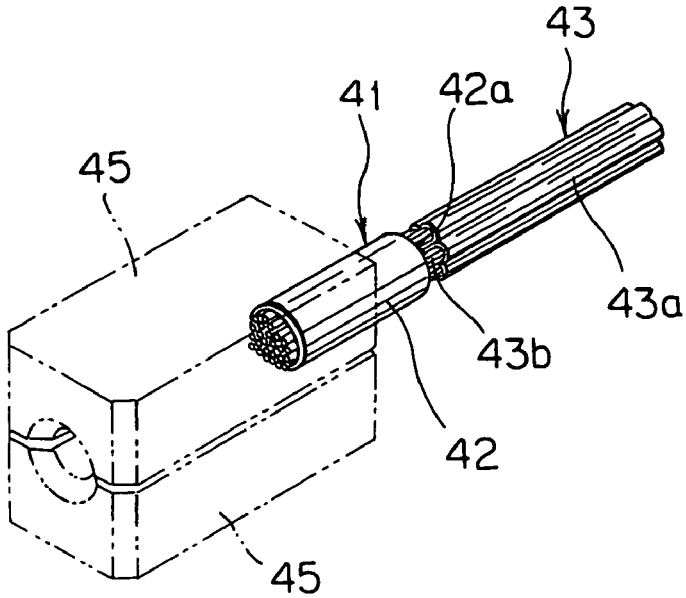
PRIOR ART FIG. 7A
FIG. 7A is a view before swaging, as an illustration of an example of a conventional jointing sleeve.
Figure 7B:
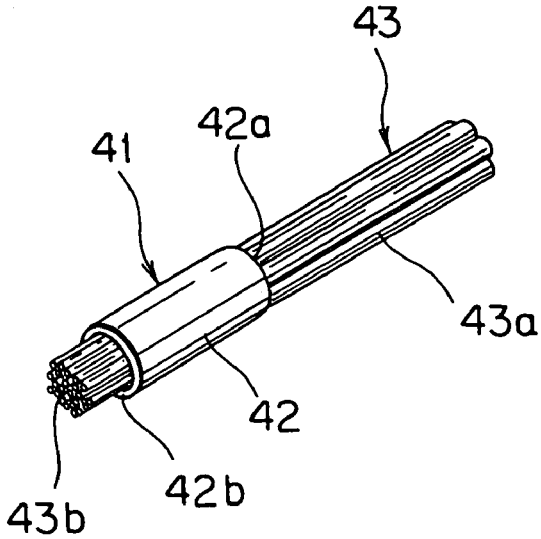
PRIOR ART FIG. 7B
FIG. 7B is a view after swaging, as an illustration of an example of a conventional jointing sleeve.

FIG. 5C shows a state when the sleeve component 1 shown in FIG. 5B is being swaged. The swaging is a compression processing, in which the outer periphery of a work piece is uniformly pressed from the peripheral direction so as to compress the work piece into a circle shape in its section by reducing the diameter thereof with small fluctuation. As shown in FIG. 8, a rotary swaging device 20 for swaging the sleeve 2 of the jointing sleeve component 1 includes: a pair of dies 21, 21 facing each other movable in the radial direction inside a rotary spindle 24; die members 22 coming in contact with the radial outside of the dies 21; and rotatable rollers 23 situated coming in contact with the radial outside of the dies 22.

The rotary swaging device 20 acts as follows. When the spindle 24 is rotated, the dies 21 and die members 22 rotate, and the rollers 23 rotate. Since the die member 22 are situated at the radial outside of the dies 21, the rotating die member 22 comes in contact with the rotating roller 23. When the cam surface 22*a* of the die member 22 runs on to the roller 23, an inner surface of the die member 22 pushes the die 21 inwardly in the radial direction, thereby an inner surface 31*a* of the die 21 hits an outer periphery of the sleeve component 1.

When the die member 22 does not come in contact with the roller 23, the die member 22 a little protrudes outwardly in the radial direction by centrifugal force, allowing the die 22 to separate from the sleeve component 1, and the hitting by the die 21 is once halted. Again, the die member 22 comes in contact with the roller 23, thereby the action described above is repeated. The insertion length of the sleeve component 1 is limited by restricting means (not shown in the figure) and the flare part 5 continuing to the sleeve 2 remains as a part that is not swaged.

The processing of the sleeve 2 is completed in several seconds or the like, thereafter the coated electric wire 35 is pulled in a reverse direction of the insertion so that the sleeve component 1 comes out from between the pair of the dies 21, 21, thereby completing the joint electric wire consisting of the sleeve component 1 and the coated electric wires 35. The sleeve component 1 may mount a pipe-shaped resin cap having a bottom (not shown in the figure) according to need so that the core wire ends 35*b* of the coated electric wires 35 is insulated and protected from water from the outside. If the resin cap filled with non-cured resin material is used, the waterproof property can be improved further.

Thus, the sleeve 2 of the sleeve component 1 is uniformly compressed in the radial direction, so that the sleeve 2 and the core wire ends 35*b* are crimped closely, and the core wire ends 35*b* are crimped with each other closely, thereby reducing the contact resistance and obtaining a stable electric property.

During the swaging, the sleeve 2 is affected by force simultaneously from three directions crossing at right angles with one another, that is, pressing force applied inwardly in the radial direction, insertion resistance in the axial direction (i e. in the wire insertion direction) and rotation force in the circumferential direction. However, since the pair of the edges 2*a*, 2*b* facing each other are engaged with each other, therefore the pair of the edges 2*a*, 2*b* is prevented from shifting in the axial direction of the sleeve 2.

Thus, in the method of connecting the end of the joint electric wire by using the sleeve component 1 according to the preferred embodiment, the end of the core wire ends 35*b* abuts against the pair of the abutting parts 3, 3 so that the coated electric wires 35 are positioned in the wire insertion direction, thereafter the pair of the crimping pieces 4, 4 is crimped so that the crimping pieces 4 are crimp connected to the insulation coatings 35*a*, that is, the coated electric wires 35 is fixed being uniformly positioned, thereby preventing the insulation coatings 35*a* from being bitten by the sleeve 2 or from peeling off, improving qualitative stability of the joint electric wire and workability of the connection of the joint electric wire.

The aforementioned preferred embodiments are described to aid in understanding the present invention and variations may be made by one skilled in the art without departing from the spirit and scope of the present invention. In the sleeve component 1 according to the preferred embodiment as described above, the pair of the abutting parts 3, 3 is formed at the front side of the sleeve 2 while the pair of the crimping pieces 4, 4 is formed at the rear side of the sleeve 2. However, instead, the sleeve component 1 may include only the sleeve 2 without the pair of the abutting parts 3, 3 and the pair of the crimping pieces 4, 4.

Alternatively, the sleeve component 1 may include only the sleeve 2 and the pair of the abutting parts 3, 3 at the front side of the sleeve 2. In this case, the sleeve component 1 is prevented from moving toward the insulating coatings 35*a* during the swaging, so that the insulating coatings 35*a* are prevented from bitten by the sleeve 2.

Alternatively, the sleeve component 1 may include only the sleeve 2 and the pair of the crimping pieces 4, 4 at the rear side of the sleeve 2. In this case, it is necessary to use a jig for uniformly positioning the core lo wire ends 35*b* and the sleeve 2. By crimping the crimping pieces 4 at a specific position, the sleeve 2 is prevented from biting the insulating coatings 35*a*.

In the sleeve component 1 according to the preferred embodiment as described above, the pair of the abutting parts 3, 3 is formed. However, instead, only one abutting part 3 may be formed. In this case, the bent abutting end 3*a* is made long so that the end of the core wire ends 35*b* abuts against the bent abutting end 3*a*.

In the sleeve component 1 according to the preferred embodiment as described above, the pair of the crimping pieces 4, 4 is formed. However, instead, only one crimping piece 4 may be formed.

In the sleeve component 1 according to the preferred embodiment as described above, the pair of the crimping pieces 4, 4 is formed at the rear end of the sleeve 2 through the flare part 5. However, instead, without the flare part 5, the pair of the crimping pieces 4, 4 may be formed at the rear end of the sleeve 2. In this case, the sleeve component 1 can be compact.

What is claimed is:

1. A jointing sleeve component comprising:

a sleeve made of electrically conductive metal, wherein a diameter of the sleeve is to be reduced by swaging on a condition that core wire ends of a plurality of coated electric wires are received in the sleeve, each core wire end being obtained by removing an insulating coating from the coated electric wire, so that the jointing sleeve component electrically connects the core wire ends to each other, wherein at an end of the sleeve an abutting part is formed, said abutting part abutting against at least a part of an end of the core wire ends, said abutting part having a portion extending in an axial direction of the electric wires and having an abutting end formed at one end thereof, said abutting end being bent inwardly at about a right angle.

2. The jointing sleeve component according to claim 1, wherein a crimping piece for crimping the insulating coatings is formed at the opposite end of the sleeve.

3. The jointing sleeve component according to claim 1, wherein an engaging part is formed at one edge of the pipe-shaped sleeve and a mating engaging part, which faces and engages with the engaging part, is formed at an opposite edge of the pipe-shaped sleeve.

4. A joint electric wire comprising:

a plurality of coated electric wires each having core wire ends obtained by removing an insulating coating from the coated electric wire; and a jointing sleeve component, including a sleeve made of electrically conductive metal, for electrically connecting the core wire ends to each other by swaging the sleeve, which sleeve receives the core wire ends therein, wherein the jointing sleeve component is the jointing sleeve component according to claim 1.

5. A jointing sleeve component comprising:

a sleeve made of electrically conductive metal, wherein a diameter of the sleeve is to be reduced by swaging on a condition that core wire ends of a plurality of coated electric wires are received in the sleeve, each core wire end being obtained by removing an insulating coating from the coated electric wire, so that the jointing sleeve component electrically connects the core wire ends to each other, wherein the sleeve is formed in a pipe-shape from a developed material, which is stamped out from a plate made of the electrically conductive metal to have a specific shape, wherein at an end of the sleeve an abutting part is formed, said abutting part abutting against at least a part of an end of the core wire ends inserted from an opposite end of the sleeve, said abutting part having a portion extending in an axial direction of the electric wires and having an abutting end formed at one end thereof, said abutting end being bent inwardly at about a right angle.

* * * * *